US007721752B2

(12) United States Patent
Stotkiewitz et al.

(10) Patent No.: US 7,721,752 B2
(45) Date of Patent: May 25, 2010

(54) PRESSURE RELIEF VALVE FOR A PACKAGING CONTAINER

(75) Inventors: Herbert Stotkiewitz, Bietigheim-Bissingen (DE); Hans-Peter Stadel, Lorch (DE)

(73) Assignee: Robert Bosch GmbH, Stuttgart (DE)

( * ) Notice: Subject to any disclaimer, the term of this patent is extended or adjusted under 35 U.S.C. 154(b) by 653 days.

(21) Appl. No.: 11/576,190

(22) PCT Filed: Sep. 8, 2005

(86) PCT No.: PCT/EP2005/054464

§ 371 (c)(1),
(2), (4) Date: Mar. 28, 2007

(87) PCT Pub. No.: WO2006/034950

PCT Pub. Date: Apr. 6, 2006

(65) Prior Publication Data

US 2008/0011751 A1 Jan. 17, 2008

(30) Foreign Application Priority Data

Sep. 29, 2004 (DE) ..... 10 2004 047 810
Dec. 23, 2004 (DE) ..... 10 2004 062 026

(51) Int. Cl.
*F16K 15/14* (2006.01)
*B65D 77/22* (2006.01)

(52) U.S. Cl. ..... 137/246; 137/533.19; 383/103

(58) Field of Classification Search ..... 137/246, 137/533.19; 383/103; 426/118
See application file for complete search history.

(56) References Cited

U.S. PATENT DOCUMENTS

| | | | | | |
|---|---|---|---|---|---|
| 2,638,263 | A * | 5/1953 | Jesnig | 383/103 |
| 3,949,934 | A * | 4/1976 | Goglio | 383/103 |
| 4,122,993 | A * | 10/1978 | Glas | 383/103 |
| 4,134,535 | A * | 1/1979 | Barthels et al. | 383/103 |
| 4,444,219 | A * | 4/1984 | Hollenstein | 137/246 |
| 4,690,667 | A * | 9/1987 | Domke | 383/103 |
| 5,263,777 | A | 11/1993 | Domke | |
| 5,354,133 | A * | 10/1994 | Rapparini | 383/103 |
| 5,584,409 | A * | 12/1996 | Chemberlen | 383/103 |
| 5,623,957 | A * | 4/1997 | Lekholm | 137/246 |
| 5,727,881 | A * | 3/1998 | Domke | 383/103 |
| 5,992,442 | A | 11/1999 | Urquhart et al. | |
| 7,240,796 | B2 * | 7/2007 | Murray | 383/103 |
| 7,294,354 | B2 * | 11/2007 | Gunter et al. | 426/118 |
| 7,490,623 | B2 * | 2/2009 | Rypstra | 137/246 |

FOREIGN PATENT DOCUMENTS

| | | |
|---|---|---|
| DE | 102 56 245 A1 | 6/2004 |
| EP | 0 499 783 A1 | 8/1992 |

* cited by examiner

*Primary Examiner*—John Rivell
(74) *Attorney, Agent, or Firm*—Ronald E. Greigg

(57) ABSTRACT

The invention relates to a pressure relief valve, comprising a base body, which is covered by a valve membrane. The base body which is located on the inner face of a packaging container, permits the escape of excess pressure from the packaging container into the atmosphere by means of passages and perforations that are configured in the wall of the packaging material. The inventive pressure relief valve thus responds particularly well. i.e. allowing particularly low opening pressures, by means of the special configuration of its base area.

20 Claims, 4 Drawing Sheets

PRESSURE RELIEF VALVE FOR A PACKAGING CONTAINER

CROSS-REFERENCE TO RELATED APPLICATION

This application is a 35 USC 371 application of PCT/EP2005/054464 filed on Sep. 8, 2005.

BACKGROUND OF THE INVENTION

1. Field of the Invention

The invention relates to a pressure relief valve for a packaging container.

2. Description of the Prior Art

DE 102 56 245 A1 has disclosed a pressure relief valve in which, in the region in which it overlaps with the base body, the valve membrane is always spaced the same distance apart from it except in the region of a recess. This makes it possible to achieve a very good seal, i.e. outside air cannot get into the interior of the packaging container. This is due to the fact that the flat contact of the valve membrane against the base body permits the sealant in the form of silicone oil between the base body and the valve membrane to provide relatively powerful adhesion forces between the valve membrane and the base body. In order to enable the pressure relief valve to better react to the occurrence of an excess pressure inside the package due to the generation of gases, however, it is necessary for the pressure relief valve to have the lowest possible opening pressure, i.e. the valve membrane should lift away from the base body extremely easily in order to produce a through conduit.

SUMMARY AND ADVANTAGES OF THE INVENTION

The pressure relief valve for a packaging container according to the invention has the advantage that it opens even at relatively low excess pressures inside the package (for example on the order of magnitude of 5 mbar), i.e. it conveys gases generated inside the package to the outside even at a relatively low excess pressure This is achieved according to the invention essentially through an embodiment of the base body that is not flat at least in some areas of the region in which it overlaps with the valve membrane. This reduces the adhesion forces between the base body and the valve membrane generated by the sealant between them and thus facilitates the lifting of the valve membrane.

Advantageous modifications of the pressure relief valve for a packaging container according to the invention are disclosed. It is particularly advantageous for the at least one through hole provided at the bottom of the base body in the region of the recess to be encompassed by a rim-like raised area. As a result, the atmospheric pressure that acts on the valve from the outside presses the valve membrane against the raised area in the region of the at least one through hole, thus closing the through hole and reliably preventing external air from penetrating into the interior of the package.

DRAWINGS BRIEF DESCRIPTION OF THE DRAWINGS

Figure 1:
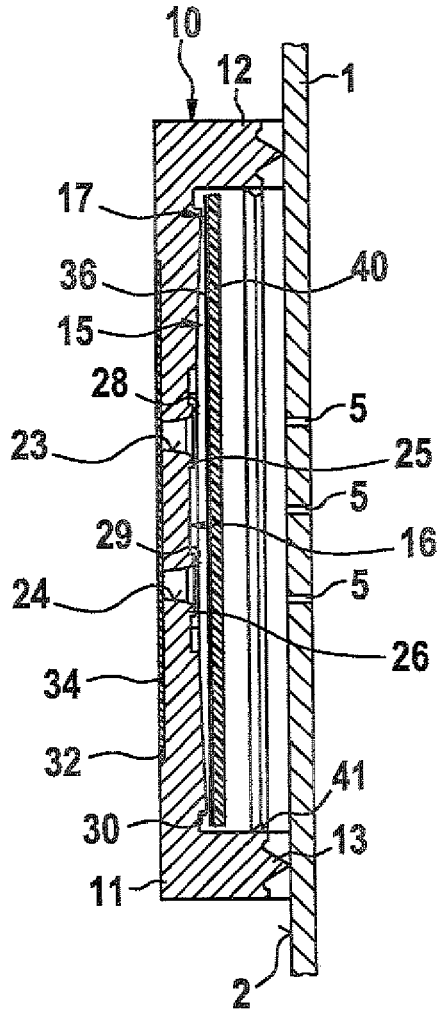
Figure 2:
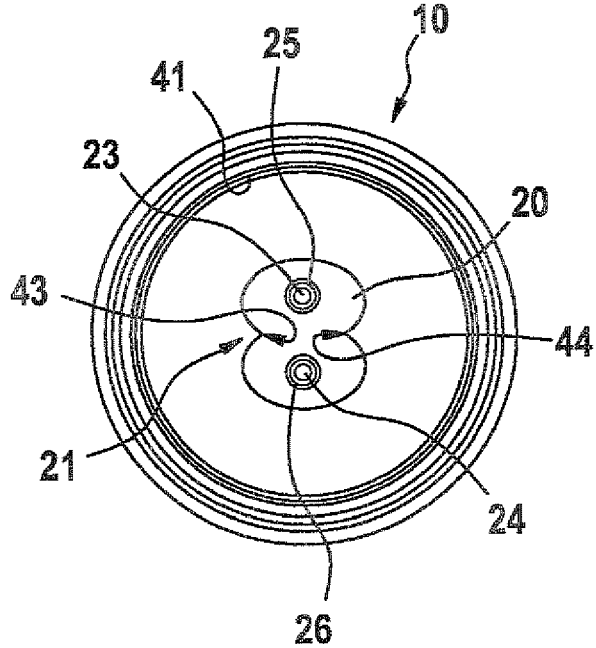
Figure 3:
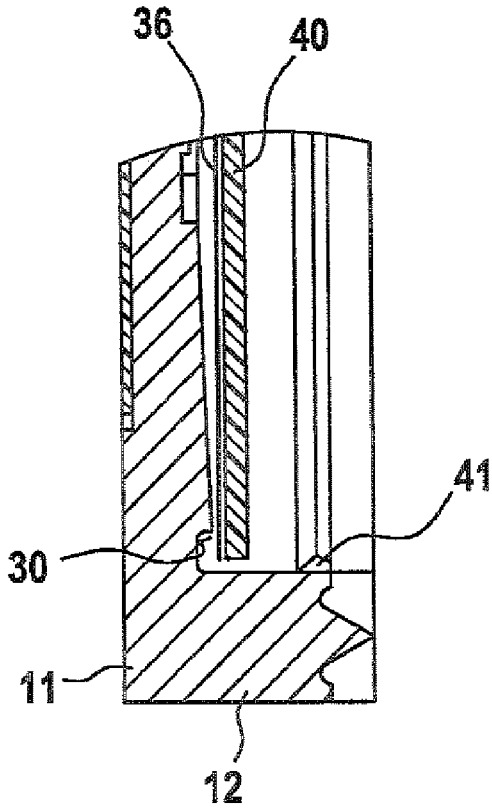
Figure 4:
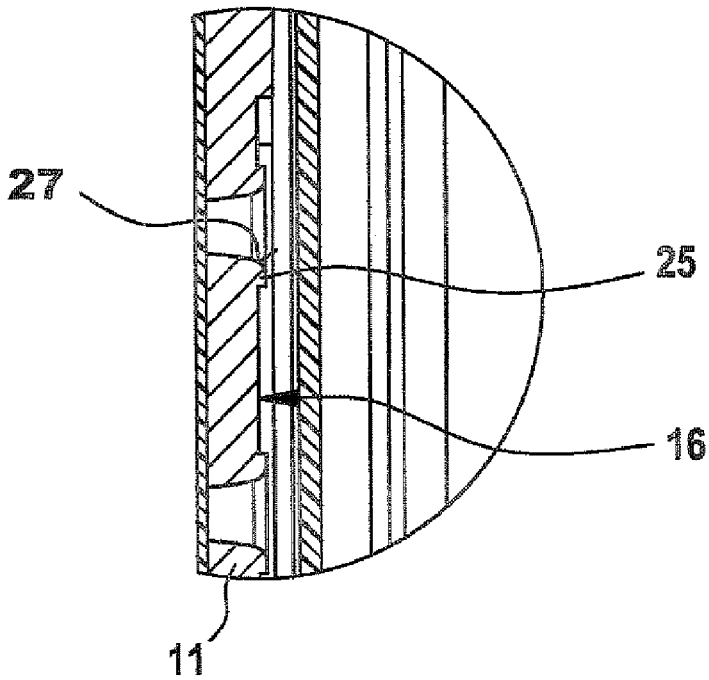
Figure 5:
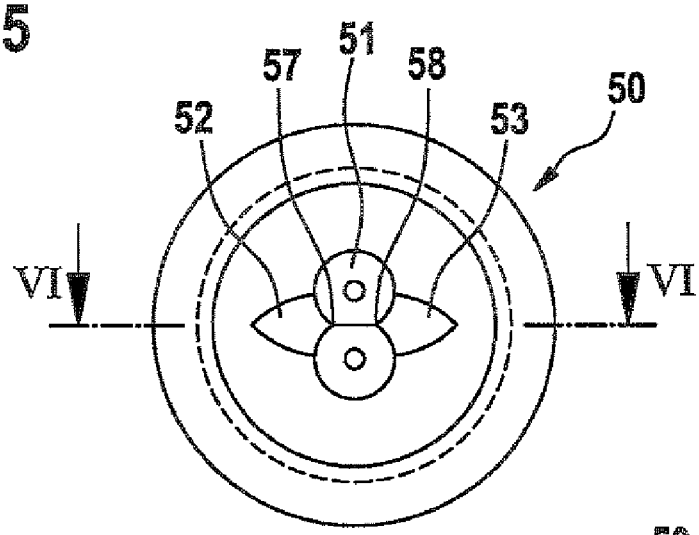
Figure 6:
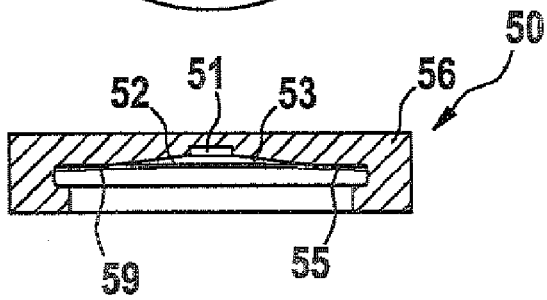
Figure 7:
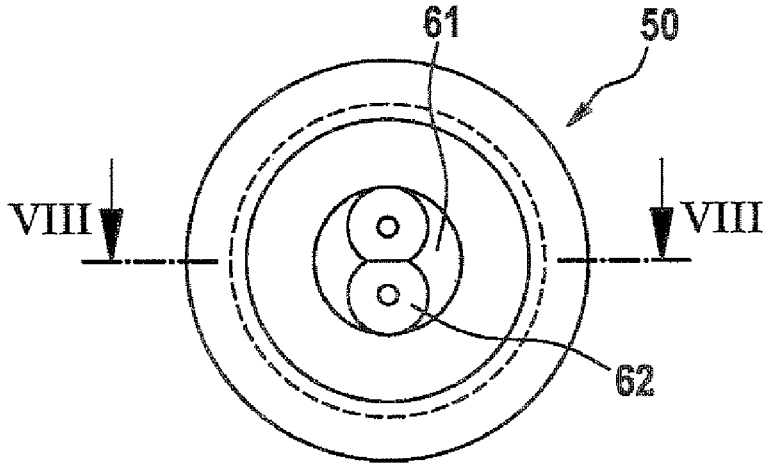
Figure 8:
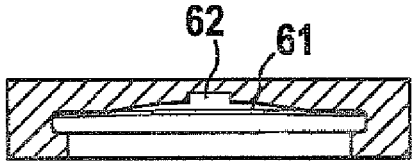
Figure 9:
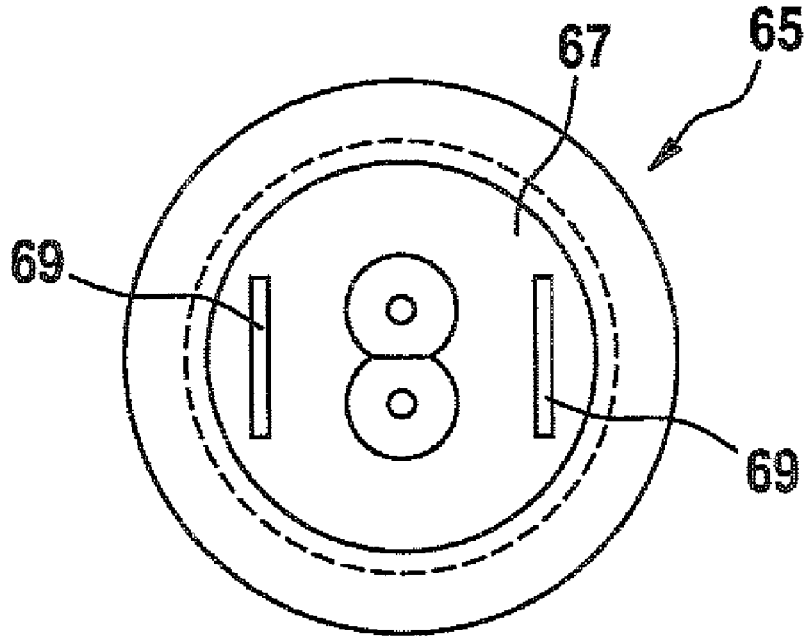
Figure 10:
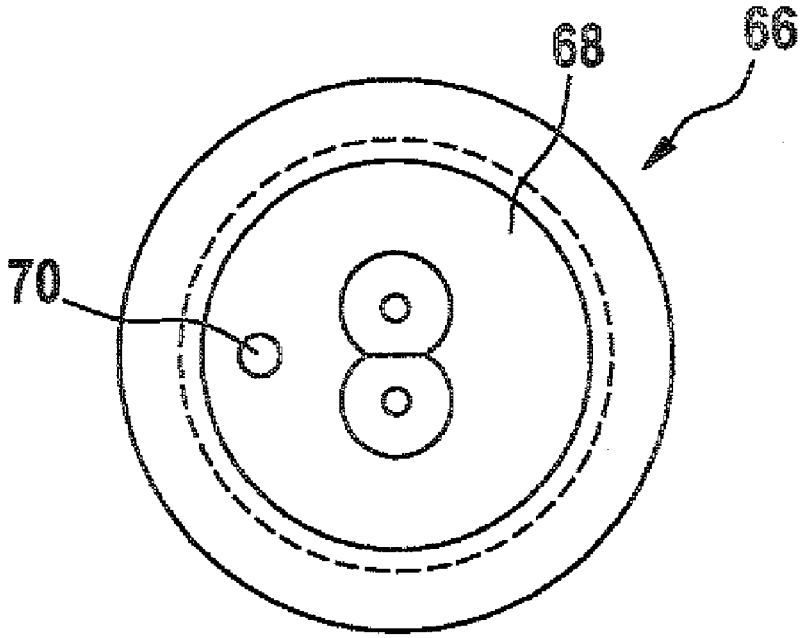

Exemplary embodiments of the invention are described more fully herein below, with reference to the drawings, in which:

FIG. 1 is a longitudinal section through a first pressure relief valve according to the invention, in the region of a packaging material wall of a packaging container, FIG. 2 is a top view of the pressure relief valve in FIG. 1, FIG. 3 shows a detail of the pressure relief valve in FIG. 1 in the vicinity of the edge region of the pressure relief valve, FIG. 4 shows a detail of the pressure relief valve in FIG. 1 in the vicinity of a tower-like raised area, FIG. 5 is a top view of a second pressure relief valve according to the invention, FIG. 6 is a section in the plane VI-VI of FIG. 5, FIG. 7 is a top view of a third pressure relief valve according to the invention, FIG. 8 is a section in the plane VIII-VIII of FIG. 7, and FIGS. 9 and 10 show top views of other pressure relief valves according to the invention.

DESCRIPTION OF THE PREFERRED EMBODIMENTS

FIG. 1 shows a first pressure relief valve 10. The pressure relief valve 10 is attached to the inside 2 of a packaging material wall 1, which, through appropriate folding and sealing, forms a packaging container or packaging pouch for packaging gas-emitting foods such as coffee.

The pressure relief valve 10 has a round base body 11 manufactured of plastic by means of the injection-molding process. The base body 11 has a circumferential edge region 12 whose end surface oriented toward the inside 2 of the packaging material wall 1 has a circumferential, cross-sectionally triangular protrusion 13 formed onto it. The protrusion 13 permits the base body 11 to be fastened to the inside 2 of the packaging material wall 1 in a sealed fashion by means of ultrasonic welding. It should also be noted that in lieu of a protrusion 13 and fastening by ultrasonic welding, it is also possible for conventional adhesives or a contact sealing process to be used in order to fasten the edge region 12 of the base body 11 to the inside 2 of the packaging material wall 1 in a sealed fashion.

In the region of the packaging material wall 1 enclosed by the edge region 12, preferably several holes, incisions, or perforations 5 are provided in the packaging material wall 1, which permit the gas produced by the food to escape to the outside of the package, i.e. to the surrounding air.

The base body 11 has a base region 15 that is recessed in relation to the edge region 12. On the side oriented toward the packaging material wall 2, the base region 15 is not planar or flat, but is instead curved. Preferably, a concave curvature is used so that the central region 16 of the base region 15 is spaced a greater distance apart from the packaging material wall 2 than the outer region 17 of the base region 15. In addition, as can best be seen by looking at both FIG. 1 and FIG. 2, the central region 16 also has a recess 20 on the side oriented toward the packaging material wall 2. Viewed from above (FIG. 2), the recess 20 is approximately the shape of a figure "8". On both sides of the constricted region 21 of the recess 20, the recess 20 contains a respective through hole 23, 24 that communicates with the package interior. On the side oriented toward the recess 20, each of the two through holes 23, 24 is encompassed by a rim-like raised area 25, 26, which is circular when viewed from above. As can best be seen in FIG. 4, each of the two raised areas 25, 26 has an inlet radius 4; the upper end surface 28, 29 of the raised area 25, 26 extends at a level situated just below the height of the base region 15 immediately adjacent to the recess 20.

It should also be noted at this point that the raised areas 25, 26 can also rise up to the level of the base region 15 in the central region 16, or can even extend beyond it.

On the outer, circumferential edge of the base region 15, an additional recess 30 is provided, which extends to the edge region 12. In addition, the side of the base body 11 oriented away from the packaging material wall 2 has a preferably round hollow 32, which extends over the two through holes 23, 24 and in which a filter element 34 in the form of a nonwoven or the like material is fastened. The nonwoven material 34 serves to prevent food particles from getting into the through holes 23, 24 and clogging them when the particle size is greater than the diameter of the through holes 23, 24.

A sealant in the form of a thin silicone oil layer 36 is applied in the vicinity of the base region 15. The silicone oil layer 36 serves as a sealant and fastening agent between the base body 11 and a likewise preferably round valve membrane 40. The diameter of the valve membrane 40 is slightly smaller than the inner diameter delimited by the edge region 12 of the base body 11.

The valve membrane 40 is likewise comprised of plastic and based on the selected thickness, is flexible to a certain degree. In order to prevent the valve membrane 40 from falling out of the base body 11, in the exemplary embodiment, a circumferential constriction 41 is formed onto the base body 11 on the inside of the edge region 12. In lieu of a circumferential constriction 41, however, it is also conceivable to use retaining fingers or the like, which are only provided in some areas.

The pressure relief valve 10 described up to this point functions as follows: the gas that the food produces during storage due to chemical transformation processes increases the internal pressure of the package until it ends up being greater than the atmospheric pressure surrounding the package. As soon as this excess pressure has reached a magnitude of 5 mbar, for example, it causes the valve membrane 40 to lift up initially in the region of the two points 43, 44 of the constriction region 21 of the recess 20. Leading from there, at least one conduit-like passage is formed in the direction toward the edge region 12 of the base body 11 until the gas can escape via the outer edge of the valve membrane 40. From there, the gas travels through the perforations 5 to the outside of the package and into the surrounding air. As soon as the excess pressure has been reduced, the valve membrane 40, starting from its edge region, lies back down against the base body 11, whereupon the silicone oil layer 36, due to its adhesion forces, produces a seal that also prevents the entry of surrounding air into the inside of the package.

In the context of the invention, the lifting of the valve membrane 40 is facilitated in that in the central region 16 that also contains the recess 20, the distance of the base region 15 from the valve membrane 40 is relatively large due to the concave design of the base region 15, so that (due to the rigidity of the valve membrane 40) the adhesion forces between the valve membrane 40 and the base body 11 are reduced in relation to those in the outer region 17. This facilitates the lifting of the valve membrane 40 in the region of the points 43, 44. The pressure relief valve 10 described up to this point therefore permits gas to escape from the inside of the package at a relatively low excess pressure (in relation to the environment). In addition, the pressure relief valve 10 seals particularly well in relation to the outside since the atmospheric pressure acting on the valve membrane 40 via the perforations 5 additionally presses the valve membrane 40 against the two raised areas 25, 26, thus closing the through holes 23, 24. In addition, the circumferential recess 30 permits silicone oil to collect in this region and this region serves as a reservoir for silicone oil, which can therefore be resupplied to the valve membrane 40 so that a relatively uniform wetting of the valve membrane 40 with the silicone oil occurs on the side oriented toward the base region 15.

In the second pressure relief valve 50 show in FIGS. 5 and 6, an outwardly tapering hollow 52, 53 extends out from both sides of the recess 51. Outside the two hollows 52, 53, the base region 55 of the base body 56 is embodied as planar or flat. Because the two hollows 52, 53 extend outward from the two points 57, 58 of the likewise figure "8"-shaped recess 51, this permits the valve membrane 59 to lift up particularly easily in the second pressure relief valve 50 as well.

In the third pressure relief valve 60 shown in FIGS. 7 and 8, the recess 61 is embodied as circular in accordance with the first pressure relief valve 10, but extends only to the edge of the recess 62.

In the pressure relief valves 65 and 66 show in FIGS. 9 and 10, no recess or the like is provided in the vicinity of the base region 67, 68 and instead, for example, two elongated stays 69 (FIG. 9) or a protrusion 70 (FIG. 10), manufactured by being injection molded in place, produce a greater distance between the base body 67, 68 and the valve membrane covering over the base body 67, 68. Consequently, in the regions of both the stays 69 and the protrusion 70, the adhesion forces between the base body 67, 68 and the valve membrane are likewise reduced in order to make for an easier lifting of the valve membrane and thus a better reaction of the pressure relief valve 65, 66 in the event of an excess pressure inside the package.

The pressure relief valves 10, 50, 60, 65, and 66 described up to this point can be modified in a multitude of ways without going beyond the concept of the present invention. This concept in particular is comprised of making it easier for the valve membrane to lift through a particular embodiment of the respective base region and overlap region with the valve membrane by increasing the distance between the valve membrane and the base body.

The foregoing relates to a preferred exemplary embodiment of the invention, it being understood that other variants and embodiments thereof are possible within the spirit and scope of the invention, the latter being defined by the appended claims.

The invention claimed is:

1. In a pressure relief valve for a packaging container, having a base body equipped with a circumferential edge region that is raised in relation to a base region; the edge region is fastened to the inside of the wall of the packaging container in a sealed fashion; in the region enclosed by the edge region, the packaging container has at least one through opening for gas; the base body has a recess in its base region encompassed by the edge region, on the side oriented toward the wall; at least one through hole leads from the bottom of the recess; and the base region, with the interposition of a sealing fluid layer, is almost entirely covered by a valve membrane, the improvement wherein the base body is embodied as not flat at least in some areas of the base region encompassing the recess so that zones of different distances between the base region and the valve membrane are produced in the surrounding region.

2. The pressure relief valve according to claim 1, wherein the base region is at least partially curved.

3. The pressure relief valve according to claim 2, wherein the curvature is embodied as concave.

4. The pressure relief valve according to claim 1, wherein the base region is provided with raised areas that hold the valve membrane spaced apart from the base region.

5. The pressure relief valve according to claim 1, wherein the at least one through hole at the bottom of the recess is surrounded by a rim-like raised area.

6. The pressure relief valve according to claim 2, wherein the at least one through hole at the bottom of the recess is surrounded by a rim-like raised area.

7. The pressure relief valve according to claim 3, wherein the at least one through hole at the bottom of the recess is surrounded by a rim-like raised area.

8. The pressure relief valve according to claim 4, wherein the at least one through hole at the bottom of the recess is surrounded by a rim-like raised area.

9. The pressure relief valve according to claim 5, wherein the raised area extends to a height below the level of the base region in the region immediately surrounding the recess.

10. The pressure relief valve according to claim 1, wherein the recess is generally in the shape of a figure "8" and the constriction region of the recess does not have any through holes.

11. The pressure relief valve according to claim 2, wherein the recess is generally in the shape of a figure "8" and the constriction region of the recess does not have any through holes.

12. The pressure relief valve according to claim 3, wherein the recess is generally in the shape of a figure "8" and the constriction region of the recess does not have any though holes.

13. The pressure relief valve according to claim 4, wherein the recess is generally in the shape of a figure "8" and the constriction region of the recess does not have any through holes.

14. The pressure relief valve according to claim 5, wherein the recess is generally in the shape of a figure "8" and the constriction region of the recess does not have any though holes.

15. The pressure relief valve according to claim 1, wherein the base region is encompassed by a circumferential recess.

16. The pressure relief valve according to claim 2, wherein the base region is encompassed by a circumferential recess.

17. The pressure relief valve according to claim 3, wherein the base region is encompassed by a circumferential recess.

18. The pressure relief valve according to claim 5, wherein the base region is encompassed by a circumferential recess.

19. The pressure relief valve according to claim 15, wherein the recess extends out to the edge region.

20. The pressure relief valve according to claim 1, wherein the base body and the valve membrane have a substantially round cross-sectional shape.

* * * * *